US005480139A

United States Patent [19]

Owen, Jr. et al.

[11] Patent Number: 5,480,139

[45] Date of Patent: Jan. 2, 1996

[54] BASKETBALL PRACTICE ASSEMBLY

[75] Inventors: Aubrey J. Owen, Jr., 273 Argilla Rd., Ipswich, Mass. 01938; Henry E. St. Louis, Jr., Center Ossippee, N.H.

[73] Assignee: Aubrey J. Owen, Jr., Ipswich, Mass.

[21] Appl. No.: 185,077

[22] Filed: Jan. 24, 1994

Related U.S. Application Data

[63] Continuation-in-part of Ser. No. 590, Jan. 5, 1993, Pat. No. 5,308,059, which is a continuation of Ser. No. 720,006, Jun. 24, 1991, abandoned.

[51] Int. Cl.[6] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 403,131 | 5/1889 | Penrose . | |
| 1,904,836 | 4/1933 | Peoples | 273/1.5 R |
| 2,253,649 | 8/1941 | Price | 248/222.4 X |
| 2,682,403 | 6/1954 | Beck | 273/1.5 R |
| 2,694,572 | 11/1954 | Crisp | 273/1.5 A |
| 2,708,576 | 5/1955 | Verkuilen | 273/1.5 A |
| 2,918,283 | 12/1959 | Marschalk | 273/1.5 A |
| 3,348,840 | 10/1967 | Dix | 273/1.5 A |
| 4,353,548 | 10/1982 | Mahoney | 273/1.5 R |
| 4,365,802 | 12/1982 | Ehrat | 273/1.5 R |
| 4,433,839 | 2/1984 | Simonseth | 273/1.5 R |
| 4,438,923 | 3/1984 | Engle et al. | 273/1.5 R |
| 4,465,277 | 8/1984 | Dittrich | 273/1.5 A |
| 4,534,556 | 8/1985 | Estlund et al. | 273/1.5 R |
| 4,613,135 | 9/1986 | Rush | 273/1.5 R |
| 4,676,503 | 6/1987 | Mahoney et al. | 273/1.5 R |
| 4,723,777 | 2/1988 | Jolly | 273/1.5 R |
| 5,022,649 | 6/1991 | Traub et al. | 273/1.5 R |
| 5,120,054 | 6/1992 | Wetzel | 273/1.5 R |
| 5,255,910 | 10/1993 | Simonseth | 272/1.5 R |

FOREIGN PATENT DOCUMENTS

| | | | |
|---|---|---|---|
| 273959A1 | 12/1989 | Germany . | |
| 0000982 | of 1902 | United Kingdom | 411/354 |

OTHER PUBLICATIONS

BPI, Basketball Products International Inc. bochure.
KBA Basketball Coaching and Training Aids catalog.
Porter Athletic Equipment Company, Goal Accessories brochure, 1992.
Gared Sports catalog, 1990–1991.

*Primary Examiner*—Paul E. Shapiro
*Attorney, Agent, or Firm*—Nixon & Vanderhye

[57] ABSTRACT

A basketball hoop assembly for improving the shooting accuracy of a basketball player, includes a basketball frame support for attachment to a basketball backboard; and a plurality of interchangeable basketball hoops, each having a different diameter, from a regulation hoop diameter of eighteen inches to one or more smaller diameters, each of the hoops having a bracket fixedly secured thereto and adapted to securely engage its respective hoop to the frame support such that a center point of each of said hoops is equidistant from the backboard when any one of the hoops is engaged with the frame support means. A hoop support and breakaway mechanism is pivotally secured to a first axle to permit the hoop assembly to pivot downwardly under a predetermined load, the breakaway mechanism including a spring loaded quick release mechanism for releasably capturing the mounting rod.

19 Claims, 13 Drawing Sheets

Fig. 15
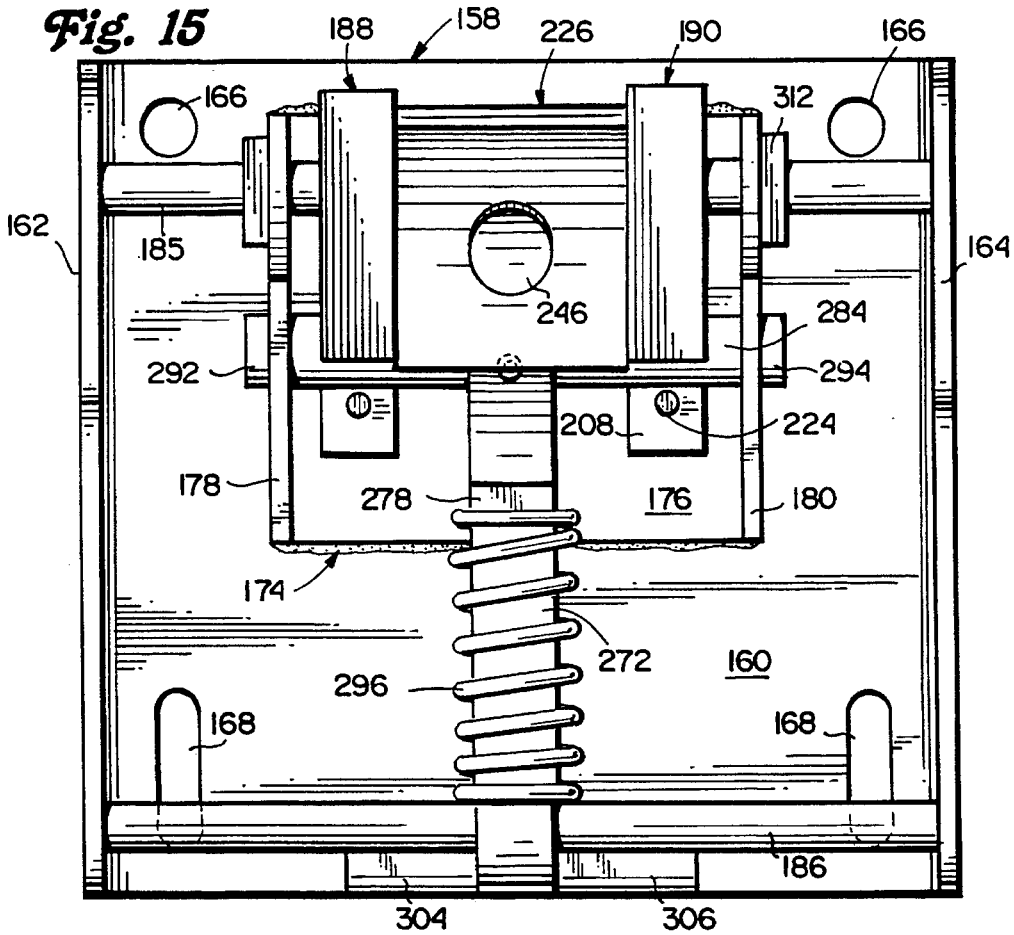
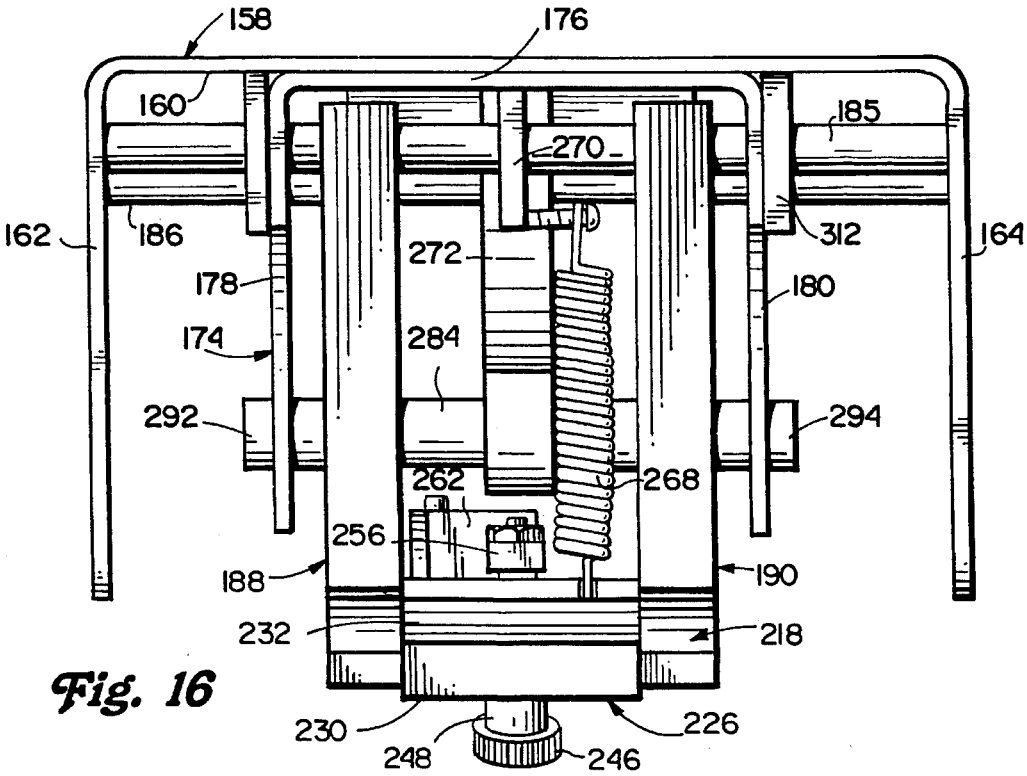
Fig. 16

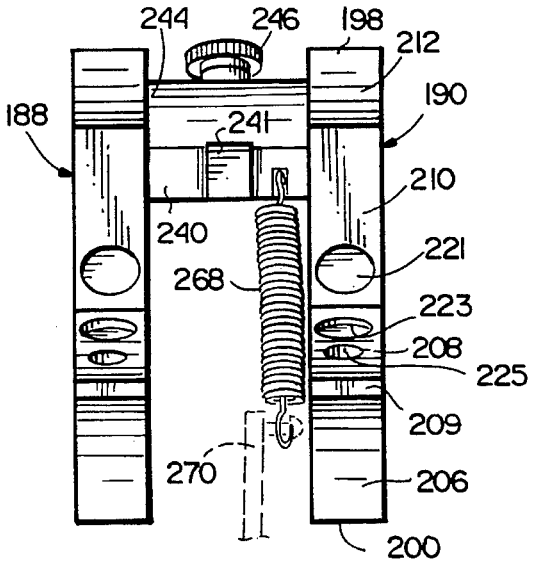
Fig. 20
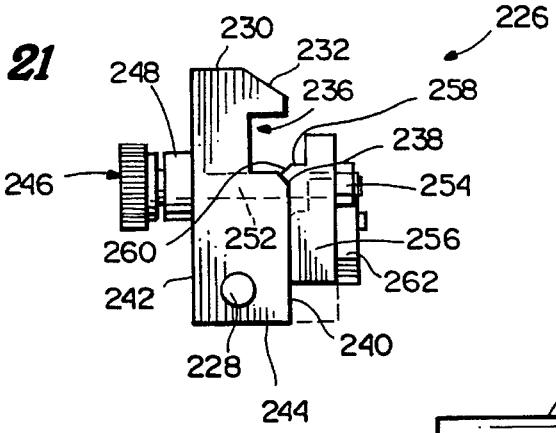
Fig. 21
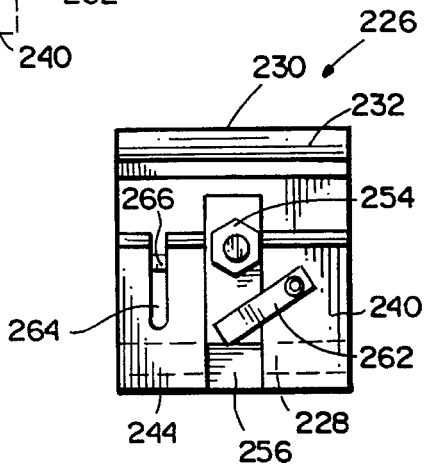
Fig. 22
Fig. 23
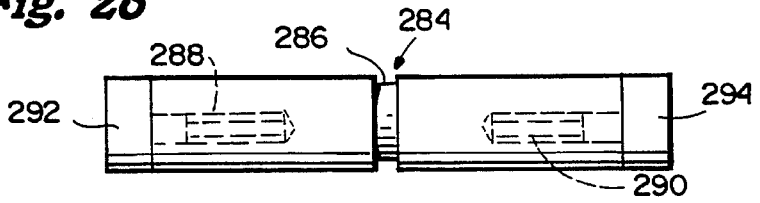

*Fig. 26*
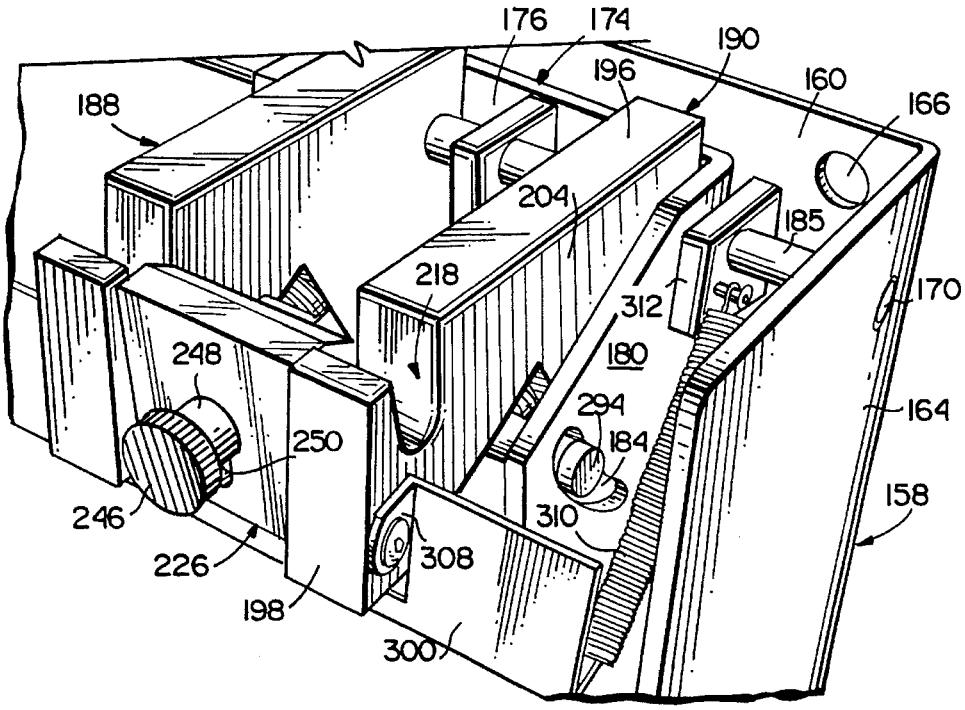
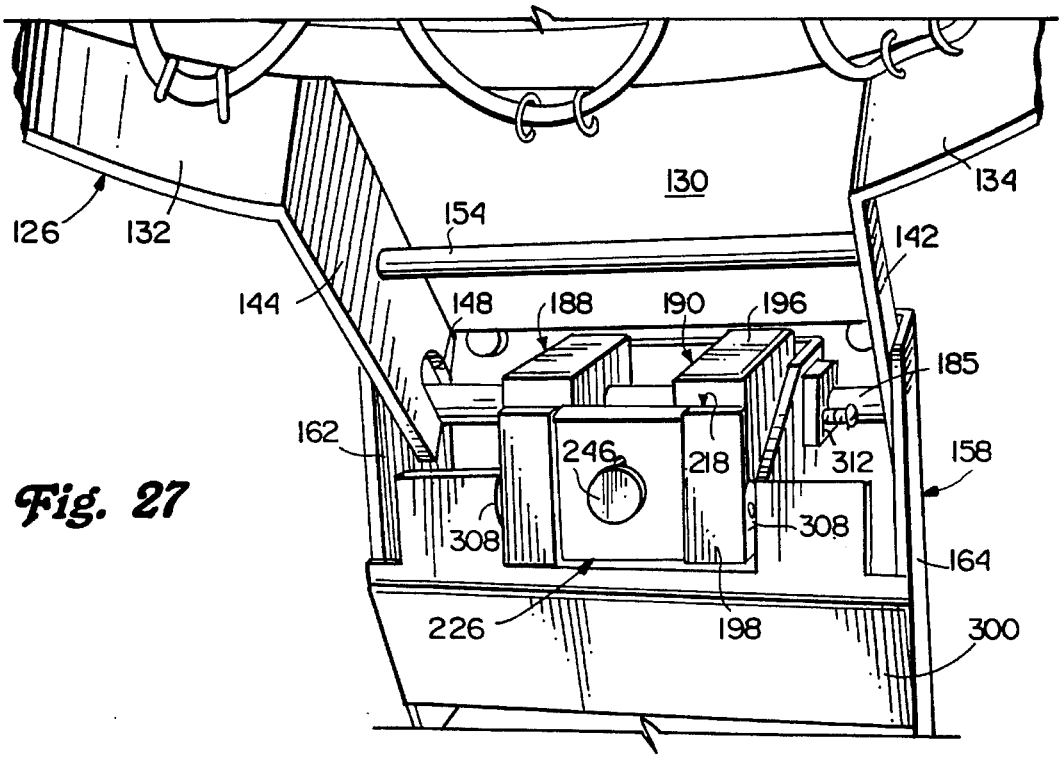
*Fig. 27*

BASKETBALL PRACTICE ASSEMBLY

RELATED APPLICATIONS

This is a continuation-in-part of application Ser. No. 08/000,590, filed Jan. 5, 1993 now U.S. Pat. No. 5,308,059, which in turn is an FWC of application Ser. No. 07/720,006, filed Jun. 24, 1991, now abandoned.

BACKGROUND OF THE INVENTION

1. Field of the Invention

This invention relates to basketball practice devices, and more particularly to a basketball hoop assembly which permits greater basketball accuracy by utilizing a plurality or hoop sizes during the practice sessions.

2. Prior Art

Basketball players have been attempting for generations to improve their shooting capabilities. In addition to long hours of shooting practice, basketball players and inventors have attempted to provide devices for helping the players achieve their aims. One such early device is shown in U.S. Pat. No. 1,904,836 to Peoples. A standard basketball hoop is attached to a backboard. An inner ring is attached by hook means to the standard basketball ring, so as to present a smaller hoop within the larger hoop.

A further device of a multiple hoop nature, is shown in U.S. Pat. No. 2,918,283 to Marschalk. This patent shows a basketball practice device with a C-shaped ring which is connectively attached to the top side of a regulation sized segment which is missing. The gap or open segment in the top most ring permits manipulation of the ring so as to easily remove it or attach it to the regular ring.

U.S. Pat. No. 4,613,135 to Rush shows a ring replacement arrangement to enable players to change from the standard diameter ring to a larger diameter ring for players of limited ability.

U.S. Pat. No. 2,694,572 to Crisp shows a basketball practice device comprising a plurality of concentric rings which are supported upon the top of a hoop to facilitate the rebounding of the basketball. U.S. Pat. No. 3,348,840 to Dix shows a rebounding apparatus which attaches to the top of a basketball hoop to permit the basketball to bounce back from the top of the ring.

Breakaway or slam-dunk mechanisms are somewhat more recent. U.S. Pat. No. 4,365,802 to Ehrat shows a swingable mount for a basketball hoop. A large compression spring is attached to the backside of the basketball board. A shaft through the spring attaches through the board into the basketball hoop. The spring permits a resilient return of the hoop once it has been knocked out of place and down angularly. U.S. Pat. No. 4,438,923 to Engle et al shows a basketball hoop about an axis.

A further breakaway arrangement for a basketball hoop, is shown in U.S. Pat. No. 4,534,556 to Estlund et al having a backboard with a tension spring extending therethrough and a release finger which holds the basketball hoop within its regular position. Force on the basketball hoop causes the finger to release and tension on the spring keeps the basketball hoop from excessive movement. Another breakaway basketball device is shown in U.S. Pat. No. 4,676,503 to Mahoney wherein an arrangement of springs or lever arms work adaptively to permit a basketball hoop to pivot in front of the backboard.

U.S. Pat. No. 4,465,277 to Dittrich shows a somewhat complicated basketball goal structure wherein a plurality of parallel arm linkages and shock absorbers are arranged to hold a basketball hoop an elongated distance from the support.

It is an object of the present invention to provide a basketball hoop arrangement which facilitates basketball players improvement in "making a basket" on a regulation size rim.

It is a further object of the present invention to provide a kit wherein a basketball assembly has a series of improvement capabilities which are stepped so as to permit a gradual sharpening of a shooters skill.

It is yet a still further object of the present invention to provide an improved quick change and breakaway mechanism for the basketball hoop assembly.

BRIEF SUMMARY OF THE INVENTION

The present invention comprises a unique assembly of basketball hoops which are utilized to improve the accuracy of a basketball shooters skill. The basketball hoop assembly comprises a basketball hoop having standard circular dimensions having a bracket attached on one side thereof. The bracket is adapted to be mounted to a frame which frame is secured to a basketball backboard. The basketball hoop is of a regulation or standard fixed distance from the basketball backboard. The standard basketball hoop and bracket may be released from the frame and replaced by a basketball hoop of a slightly smaller dimension. The smaller dimensioned hoop has a slightly longer bracket, so that the center of the subsequent (smaller) hoop is the same distance from the backboard as was the standard regulation size basketball hoop. Several of these hoops may be utilized in a step wise reduction in overall diameter, so as to sharpen or refine a basketball shooters concentration and capability as one practices on smaller than regulation size ring. As a basketball shooters proficiency increases on the smaller rings, shooting concentration, capability and confidence will improve when one plays again on the regulation size rim. Each successive diameter hoop has the same center location as does a standard basketball hoop. The only difference is that successively smaller diameter basketball hoops have proportionately longer brackets attached thereto, the brackets each successively attaching to the common frame mounted on the backboard. Replacement of one bracket for another bracket only changes the size of the hoop not the distance of the center of the hoop from the backboard.

In one embodiment of the present invention, a ring breakaway mechanism is supported on the frame which is attached to the backboard. The breakaway mechanism includes a piston and cylinder which is pivotable about a horizontal axle attached to the back frame. The piston, acting as a shock absorber has a shaft extending therefrom which is attachable to a horizontally disposed axle which shock absorber is compressively adapted so as to engage the bracket or a basketball hoop into the extending portion of the frame. The second compressive pin is attached to the frame member to act as a pivot access for the bracket and the first compressive pin assembly which is attached to the piston and cylinder unit. The appropriate force on the basketball hoop causes the piston and cylinder to compress and the pin to act as a cam follower within a slot in the support frame. The shock absorber or piston and cylinder unit cause the basketball hoop to return to its normal horizontal configuration once the force has been removed. Successively sized basketball hoops from the regulation size and smaller, may be removed from the breakaway apparatus by compression of the two pins in each axle arranged between the bracket and the support frame. Compression of each of these springs permits the pins to be withdrawn from their relationship between the hoop bracket and the frame, thus permitting a successive different horizontal length bracket and different size hoop to be readily installed onto the backboard.

In another embodiment, in accordance with this continuation-in-part application, an improved hoop support and breakaway mechanism is combined with a quick-release mechanism for creating the feel and characteristics of a solid mounting, up to a predetermined breakaway load, while at the same time permitting rapid and easy replacement of a rim or hoop assembly. In this embodiment, the hoop assembly is secured at its rearward end for pivotal movement about an upper horizontal axle within an outer frame support, and a transverse rod within the hoop assembly is releasably locked within the hoop support and breakaway mechanism which is also mounted for pivotal movement about the same horizontal axle.

Pivotal movement of the hoop assembly and the hoop support and breakaway mechanism is controlled by a spring control rod extending between a lower horizontal axle and a transverse cam pin extending between a pair of laterally spaced arcuate slots in respective side walls of an inner frame support secured within the outer frame support.

The cam pin is located and arranged so as to operatively connect the spring control rod to a pair of pivotally mounted hoop assembly support blocks and an associated quick release locking bar. In this way, a vertically oriented coil spring mounted on the control rod serves to resist downward breakaway movement of the hoop assembly and to return the hoop assembly to its normal operative position when the breakaway force is no longer present.

Significantly, additional spring elements are employed to exert a horizontal force on the cam pin to releasably lock the same within detents formed in the arcuate cam slots to thereby prevent any undesirable downward pivotal movement of the hoop assembly until the predetermined breakaway force is applied. In this embodiment, it will be appreciated that the combined spring rates of the coil spring and additional spring elements set the breakaway force, while the coil spring also serves to return the hoop assembly to its normal operating position.

Thus, in one aspect, the present invention relates to a basketball hoop assembly fix improving the shooting accuracy of a basketball player, comprising a basketball frame support means for attachment to a basketball backboard; and a plurality of interchangeable basketball hoops, each having a different diameter, from a regulation hoop diameter of eighteen inches to one or more smaller diameters, each of the hoops having a bracket fixedly secured thereto and adapted to securely engage its respective hoop to the frame support means such that a center point of each of the hoops is equidistant from the backboard when any one of the hoops is engaged with the frame support means.

In another aspect, the invention provides a method of improving the shooting accuracy of a basketball player comprising the steps of removing a first standard hoop having a diameter of 18" and a center point that is located a predetermined distance from the backboard, and replacing, without the use of any tools, the first hoop with another hoop having a smaller diameter than the first hoop, wherein the another hoop has a center point located the predetermined distance from the backboard.

In still another aspect, the invention relates to a kit for the retrofitting of a basketball backboard so as to improve the shooting accuracy of a basketball player, including a quick-change basketball hoop frame support means for attachment to the basketball backboard; and a plurality of interchangeable basketball hoops of different diameters, each of the basketball hoops having its own quick-change bracket thereattached, each of the brackets being matable in a common manner, one at a time, to the frame support means; each one of the brackets having a predetermined horizontal length selected as a function of hoop diameter so that each of the hoops has as common center point located at a substantially identical horizontal distance from the backboard when any one of the hoops is attached to the backboard.

In still another aspect, the invention relates to a basketball hoop and hoop support assembly comprising a first outer frame support adapted for attachment to a backboard and having an upper transverse axle secured therein; a hoop assembly including a hoop and a mounting bracket, the mounting bracket having a pair of sides, each with a slot adapted to engage the first axle, the mounting bracket also having a mounting rod extending between the sides and parallel to the first axle; and a hoop support and breakaway mechanism located within the first outer frame support and pivotally secured to the first axle for permitting the hoop assembly to pivot downwardly under a predetermined load, the breakaway mechanism including spring loaded quick release means for releasably capturing mounting rod.

In still another aspect, the invention relates to a basketball hoop and hoop support assembly comprising a first outer frame support adapted for attachment to a backboard and having an upper transverse axle secured therein; a second inner frame support secured within the first outer frame; a hoop assembly including a hoop and a mounting bracket, the bracket having a pair of sides, each with a slot adapted to engage the first axle, the mounting bracket also having a mounting rod extending between the sides and parallel to the first axle; and a hoop support and breakaway mechanism located within the first frame support and pivotally secured to the first axle permitting the hoop assembly to pivot downwardly under a predetermined load; wherein downward pivoting movement of the breakaway mechanism is opposed by substantially horizontal and substantially vertical spring forces.

Additional objects and advantages of the invention will become apparent from the detailed description which follows.

BRIEF DESCRIPTION OF THE DRAWINGS

The objects and advantages of the present invention will become more apparent when viewed in conjunction with the following drawings, in which:

FIG. 15 is a front elevation of the hoop support and breakaway mechanism;

FIG. 16 is a top plan view of the hoop support and breakaway mechanism shown in FIG. 15;

FIG. 20 is a front elevation of a pair of hoop support blocks and lock block, with certain elements removed for clarity;

FIG. 21 is a side elevation of the lock block illustrated in FIG. 20;

FIG. 22 is a rear elevation or the lock block shown in FIG. 21;

FIG. 23 is a front elevation of a cam roller pin used in the hoop support and breakaway mechanism;

FIG. 26 is a partial perspective of the hoop support and breakaway mechanism in accordance with the invention; and FIG. 27 is a partial perspective of the hoop assembly, illustrating the manner of attachment to the hoop support and breakaway mechanism.

DESCRIPTION OF THE PREFERRED EMBODIMENTS

Figure 1:
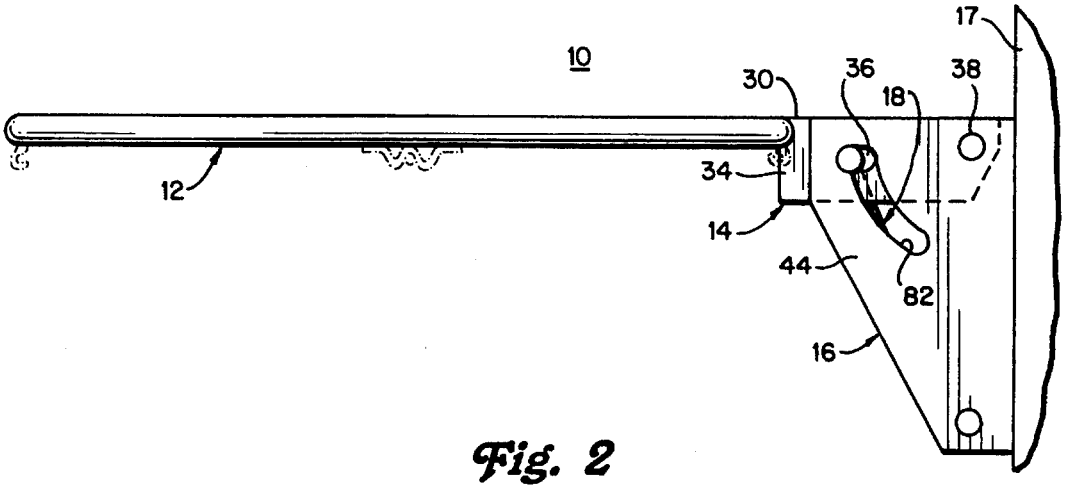
FIG. 1 is a side view of a basketball hoop having a bracket attached to one side thereof, the bracket mounted in a frame, which frame is attachable to a basketball backboard.

Referring now to tile drawings in detail, and particularly to FIG. 1, there is shown a basketball hoop assembly 10, in a side elevational view, including a first hoop 12, a hoop bracket 14 secured to an arcuate segment 16 of the first hoop 12, the hoop bracket 14 pivotably adapted onto a frame support 16. The frame support 16 is normally attached to a vertically disposed backboard, 17.

The first hoop 12 is a standard (regulation) size circular hoop of 18 inches in inner diameter, having a center point "C" which is held the regulation distance "D" of 15 inches from a backboard. The first hoop 12 is being held by its bracket 14 comprised of an inverted generally channel or U-shaped member, the requisite distance "D" from the backboard.

The frame support 16 may include a hinge mechanism 18 arranged therewith, as partially shown in FIG. 1 and shown more explicitly in figures 2–7.

Figure 2:
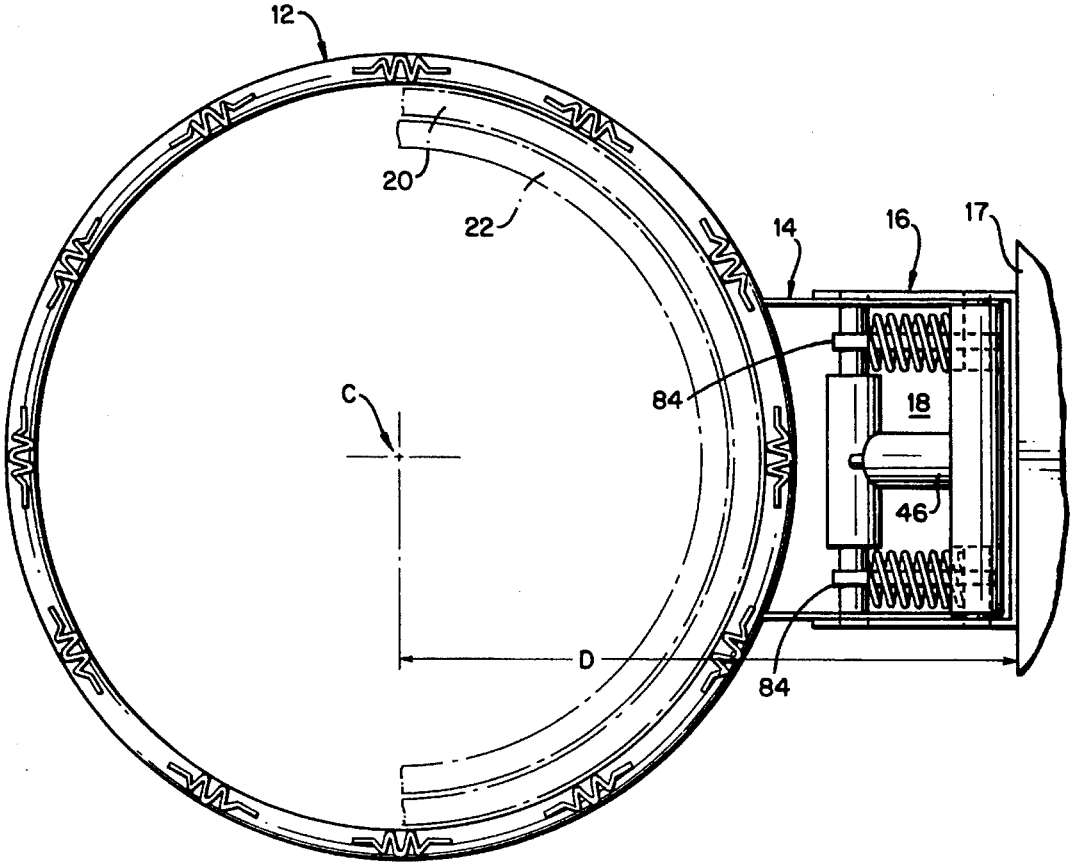
FIG. 2 is a view looking vertically upwardly from beneath a basketball hoop assembly of the present invention including the breakaway assembly device.

The present invention also includes at least a second hoop 20, shown in the upwardly directed view of the hoop assembly 10, in FIG. 2. The second hoop 20 is shown in phantom lines and has a diameter of 16½ inches, having the same center point "C" as the first hoop 22. A third hoop 22, also, shown in FIG. 2 in phantom lines, has a diameter of about 15 inches. The second hoop 20 and each subsequent hoop 22 et al, each have their own bracket, similar to the bracket 14 as shown for the first hoop 12, except that each respective bracket is slightly longer horizontally (the difference of the radius between the successive hoops) to make up proportionately for the reduction in diameter of their respective hoops 12, 20 and 22, so that each hoop 12, 20 and 22 will have common center points, that is, the distance from the backboard 17, will be the same. This is critical to one aspect of the invention as described below.

When a basketball player is adequately experienced on a "regulation" or standard size ring 12 and wants to improve his/her game, ideally they would install the next smaller size hoop 20 and work downwardly in diameter from that one, to ultimately install the smallest diameter hoop 22 and its associated attached bracket, to the frame support 16, through the hinge mechanism 18, to the backboard. The basketball shooters see only a single hoop, albeit a smaller diameter one initially, as their only target. Over time, as they practice on the smaller hoop 22, their concentration and precision shooting improves. After becoming proficient on the smaller hoop 22, they could return to using the standard "regulation" size hoop 12 and realize an increase in shooting concentration, ability and confidence. To further improve in these areas, the player could install the next smaller hoop 22 with its own bracket, and continue to practice until proficiency at this more difficult level is achieved. It is critical also, that the basketball shooters see only the rim of a single hoop when they are throwing the basketball, whether the hoop is small, intermediate or of standard diameter hoop. The single rim of a hoop of a nonstandard size hoop, each with the "from backboard to center of hoop" distance the same, permits a basketball shooter to improve his game as he positively adapts to the stepwise changes in the size of the hoops. The more time spent practicing on the smaller than "regulation" size hoops, the greater will be ones proficiency and skills when he returns to the full "regulation" size hoops 12.

Each hoop 12, 20 and 22 et al, each having its own bracket 14, differing only in their length by an amount equal to the difference in the radius of the successive hoops, is readily attached and detached from the frame support 16. Each bracket, as exemplified by the bracket 14, is the same, except for its length, as aforementioned. Each bracket then, of U-shaped configuration, has a planar upper portion 30, as may be seen in FIGS. 1 and 4, and it has downwardly directed side flanges 32 and 34. Each side flange 32 and 34 has an elongated slide opening 36 and a pivot opening 38 at its distalmost end, as shown in FIG. 1.

Figure 5:
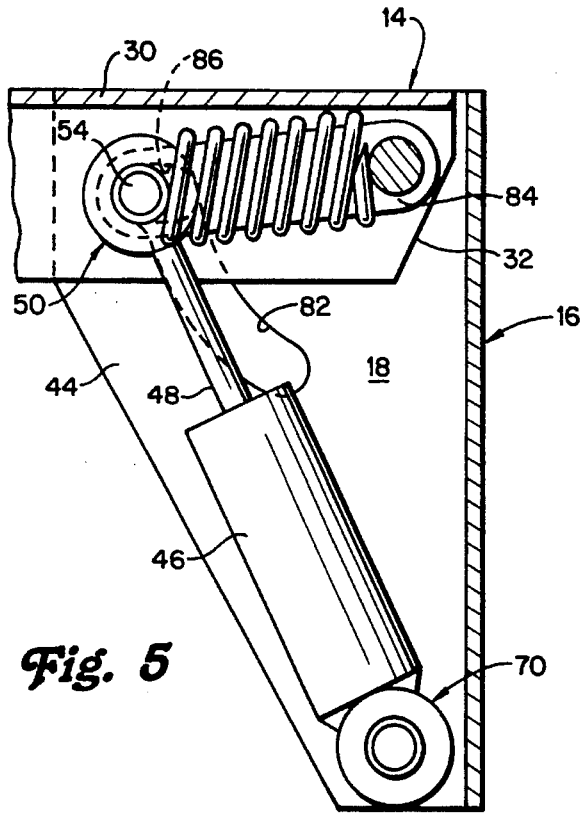
FIG. 5 is a side elevational view of a portion of the breakaway assembly in the frame and bracket arrangement.
Figure 6:
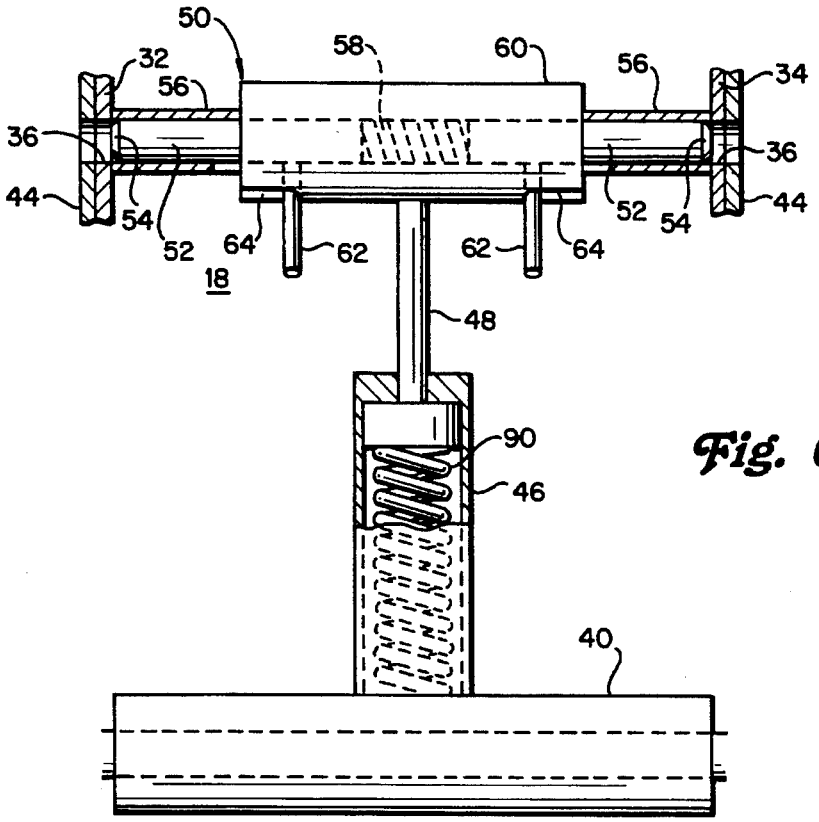
FIG. 6 is a presentation of the piston and cylinder arrangement with one of the compressive pins adapted between a portion of the bracket and the frame, portions being cut away for clarity of the illustration.

The hinge mechanism 18 permits in its preferred embodiment, a slam-dunk of any basket hoop 12, 20 or 22. The hinge mechanism 18, a shown in FIGS. 2–7, comprises a lower pivot axis 40 fixedly disposed through a pair of openings 42, one each in the lower side flange 44 of the frame support 16, as shown in FIG. 1. A compressible piston and cylinder arrangement 46 is secured to the mid point of the lower pivot axis 40. A longitudinally recipricable piston shaft 48 extends out of the piston and cylinder arrangement 46, in a known manner. The piston shaft 48 has a distal end which is attached to the mid-point of a first quick release compressive axle 50. The first compressive axle 50 has a pair of pins 52 the outer ends 54 of which extend through the elongated hole 36 in the side flanges 32 and 34 of the bracket 14, as shown in FIGS. 1 and 5. The pins 52 of the first compressive axle 50 are held in a barrel 56, and are separated by a compressive spring 58, in a housing 60, to which the barrels 56 are attached, as shown in FIG. 6.

Each pin 52 has a thumb latch 62 arranged at its inner end, which latch 62 is in sliding engagement with a slot 64 at each end of the housing 60. Pushing together manually of the latches 62 compresses the spring 58, and withdraws the ends 54 of the pins 52 from the openings 36 in the bracket 14.

Figure 3:
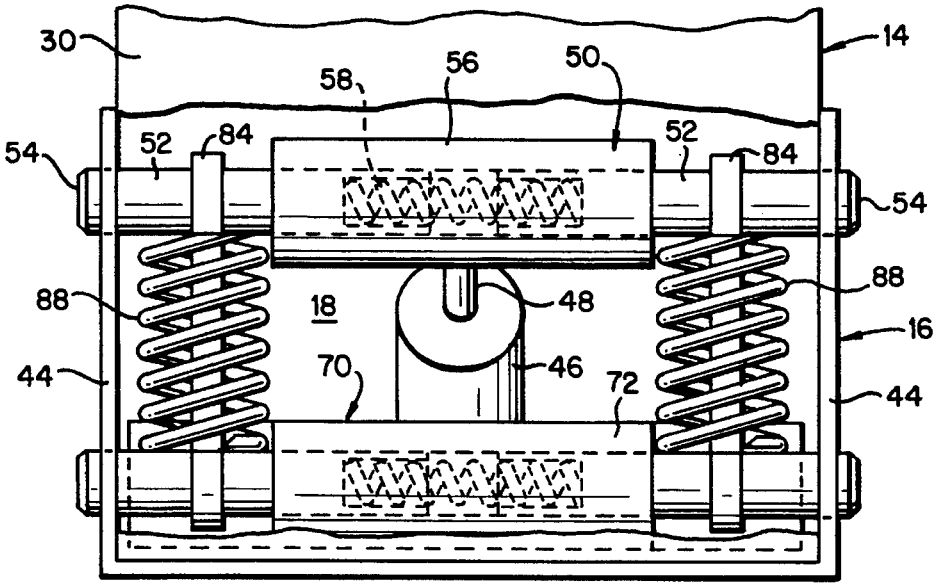
FIG. 3 is a plan view of the breakaway assembly component with portions of the bracket cut away for clarity of illustration.
Figure 4:
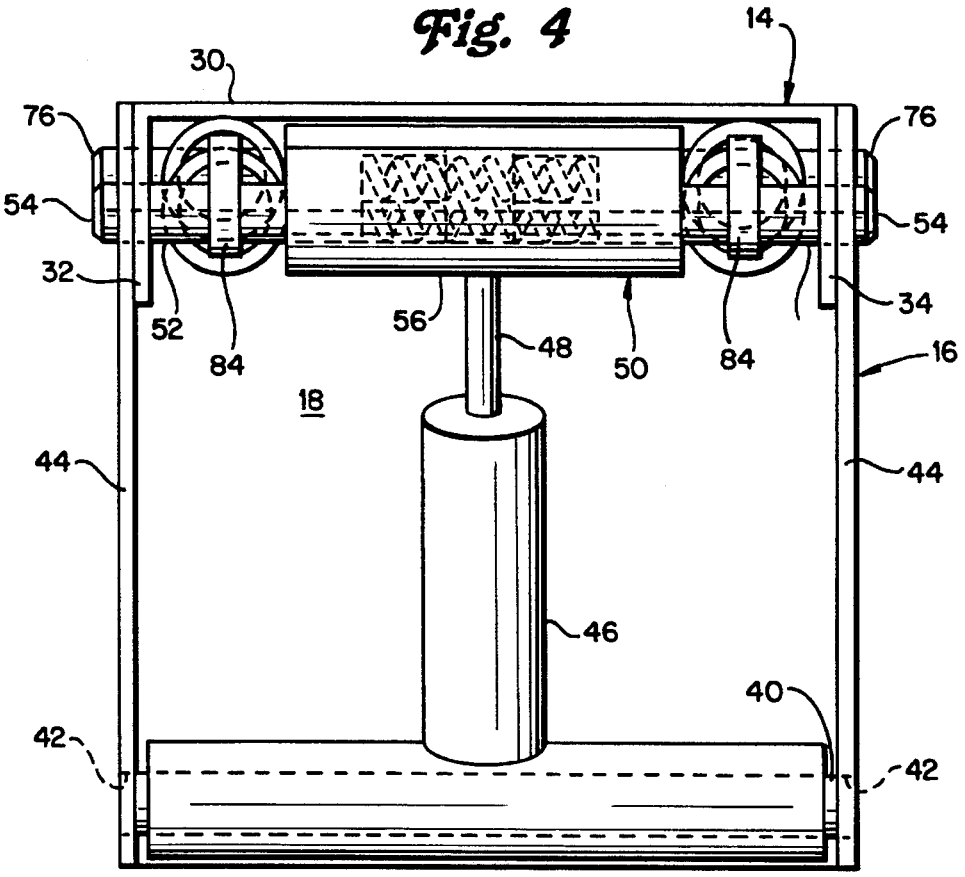
FIG. 4 is a front elevational view partly in section, of the bracket and breakaway assembly arranged within the frame.
Figure 7:
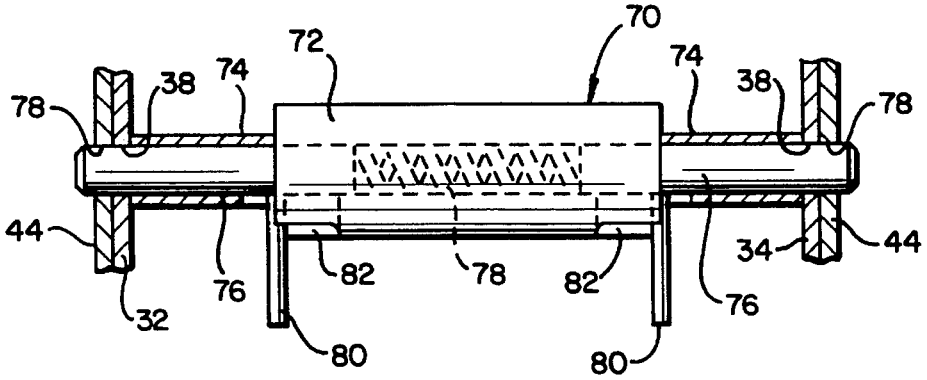
FIG. 7 is a side elevational view of the second pin assembly in the breakaway assembly with portions deleted for clarity of the illustration.

A second quick release-type compressive axle 70 is shown in FIG. 3, and is shown partially, behind the first compressive axle 50 in FIG. 4, and is shown most completely in FIG. 7. The second compressive axle 70 comprises a tubular housing 72 having a barrel 74 extending at each end thereof, as shown best in FIG. 7. A pin 76 is movably disposed within each barrel 74. A compressive spring 78 is arranged within the housing 72 between the inner ends of the pins 76. Each pin 76 is retractably disposed through the pivot opening 38 in each side flange 32 and 34 of the hoop bracket 14, and through a corresponding opening 78 in the side flange 44 of the frame support 16. Each pin 76 has a latch 80 secured to its inner end, similar to that of the first compressive axle 50. A slot 82 longitudinally arranged at the each end of tile housing 72 permits the latches 80 to be squeezed together to compress the spring 78 to withdraw and retract the pins 72 from interlocking engagement with the aligned openings 38 and 78 in the side flanges 32 and 34 of the bracket 14 and the side flanges 44 of the frame support 16, to permit the second compressive axle 70 to be removed while changing from one hoop size to another on the frame support 16. The second compressive axle 70 is the pivotal axis, which allows the slam dunk of the hoops to take place.

The distal ends 54 of tile pins 52 ill the first compressive axle 50 are allowed to slide a slight in "S-shaped" curvilinear cam slot 82 arranged in the side flanges 44, as shown in FIGS. 1 and 5.

An elongated link 84 is articulably disposed between the first and second compressive axles 50 and 70, as shown in FIGS. 2, 3, 4 and 5. Each link 84 has an opening therein which mates about the barrel 74 at each side of the housing 72. Each link 84 has an elongated slot 86 at its forward end. The slot 86 is disposed about each pin 52 of the first compressive axle 50. A compressive spring 88 is disposed about each link 84 biasing the first and second compressive axles 50 and 70 apart. During a "slam dunk" play, a basketball player hits the hoop 12, 20 or 22 et al with a downward force causing a slight rearwardly directed motion of the first compressive axle 50 within the slots 86 in the links 84 and a tracking downwardly of the pins 52 in the slight "S"-shaped cam slot 86 in the side flanges 44 of the frame support 16, allowing whichever hoop 12, 20 or 22 and its respective bracket 14 being utilized, to pivot downwardly about the second compressive axle 70 holding its place securely within the aligned openings 38 and 78 between the bracket flanges 32/34 and the frame support side flanges 44. The piston and cylinder arrangement 46, shown in a sectional representation in FIG. 6, compresses by receiving the inwardly directed piston shaft 48, compressing a spring 90 therewithin.

Upon removal of the downward force upon the hoop 12, 20 or 22, the spring 90 thus pushes that hoop 12, 20 or 22 into its normal horizontal orientation, the distal ends 54 of the pins 52 snapping into the uppermost end of the cam slot 82 and the forwardmost end of the elongated opening 86 in each link 84.

Figure 8:
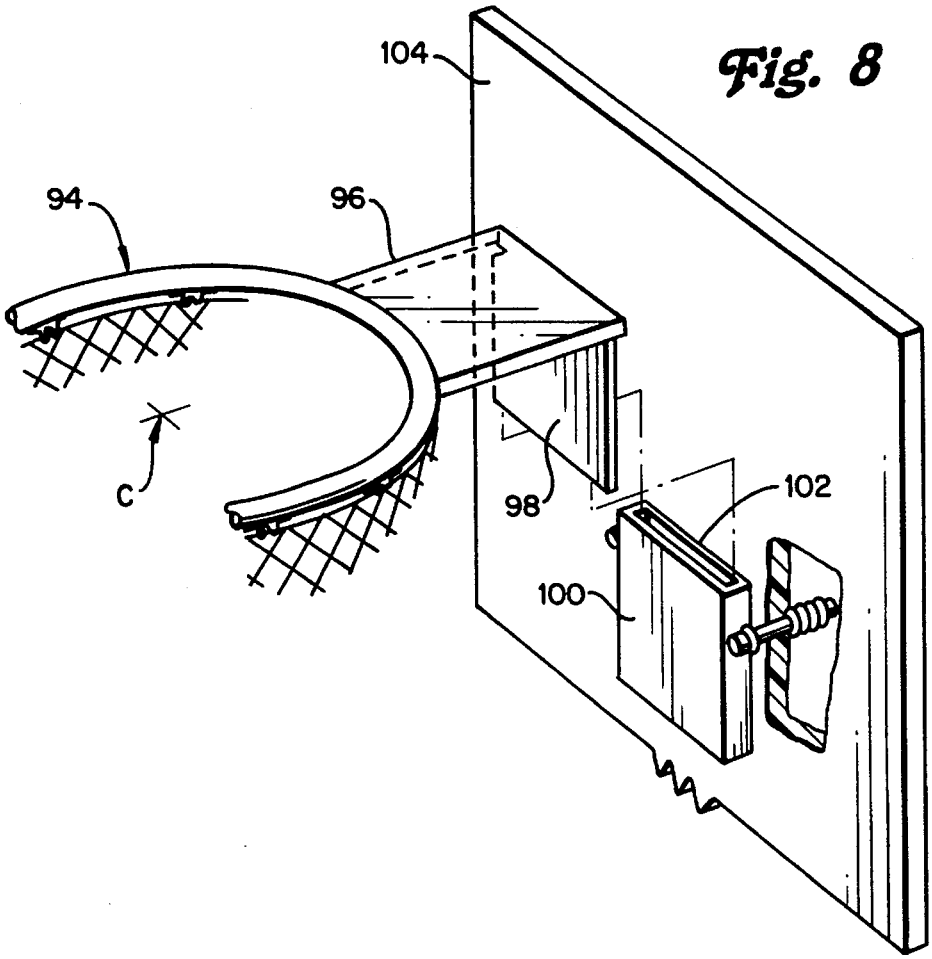
FIG. 8 shows a further embodiment of a basketball hoop with a bracket and frame assembly attached to a backboard.

A further embodiment of a basketball hoop according to the present invention is shown in FIG. 8, wherein a basketball hoop 94 has a bracket 96 attached at one side thereof. The bracket 96 comprises an "L"-shaped arrangement, having a downwardly directed flange 98 which is received in a housing 100 having an elongated receiving slot 102. The housing 100 is secured to a backboard 104. The hoop 94 has a center identified in FIG. 8, as "C". A hoop of a smaller diameter, but a correspondly longer bracket would be secured to successively smaller hoops, so as to keep the center point "C" equidistant from the backboard 104 as any other hoop and bracket in an assembly or kit which comprises the array of multisized hoops and their associated multi-length ("C" to backboard) brackets.

Figure 9:
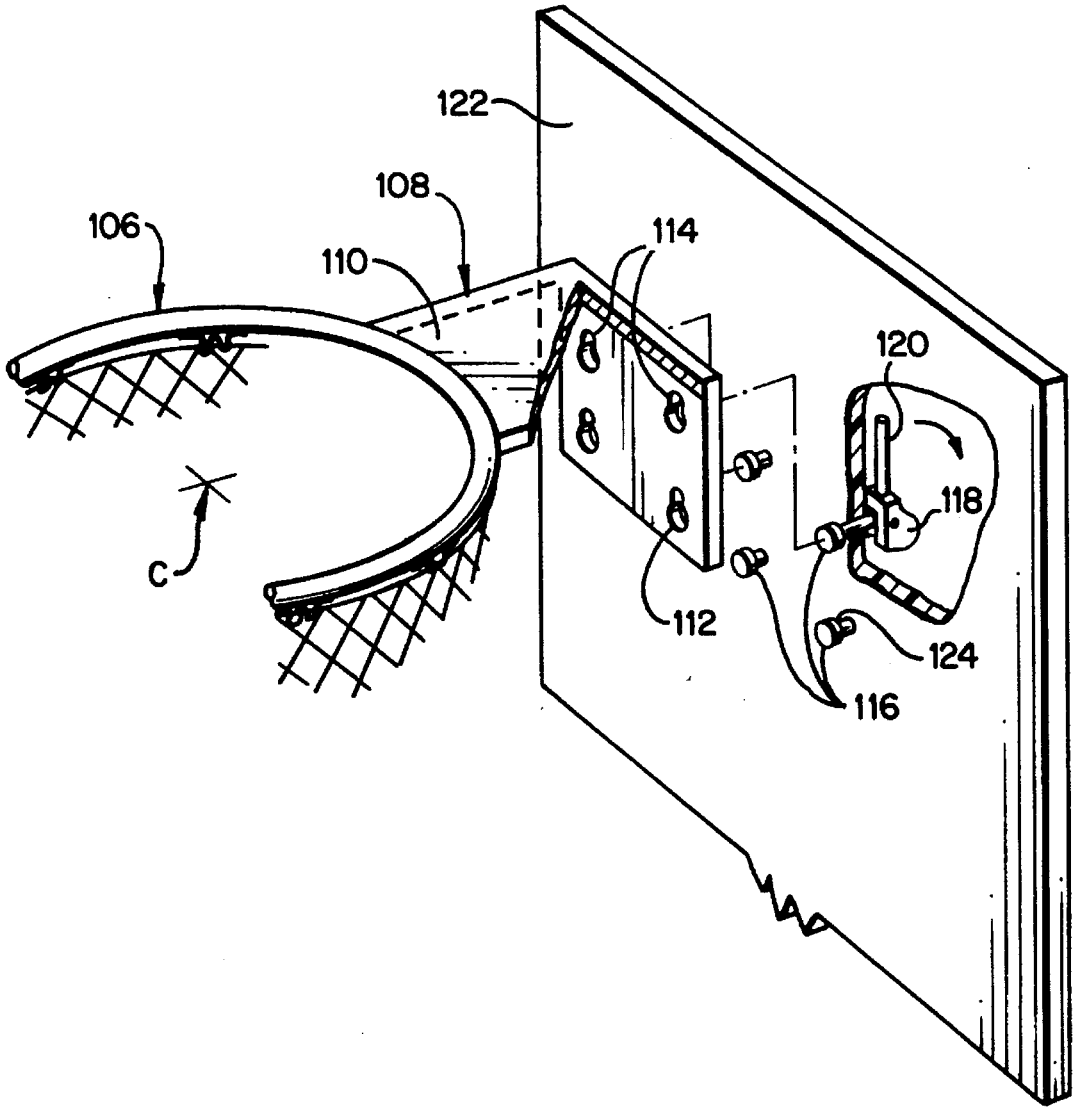
FIG. 9 is yet a further embodiment of a basketball hoop and bracket assembly on a quick release support mechanism on a backboard.

A yet further embodiment of a multi hoop quick change arrangement is shown in FIG. 9, wherein a basketball hoop 106 of one particular diameter, having a center point "C" is shown with "L"-shaped bracket 108 attached thereto. The "L" shaped bracket 108 has an upper portion 110 and a downwardly directed flange 112. The flange 112 has a plurality of elongated slots 114 having wider open portions at the lowermost portion of those slots 114, as shown in FIG. 9. Each slot 114 may receive an adjustable bolt 116, which bolts 116 have a pivotable cam fixture 118 on their rearward end. Pivotable movement of an arm 120 pivots the cam fixture 118 into or out of frictional engagement with respect to the backside of the backboard 122. The bolts 116 have heads 124 which pass through the wide portion of the slots 114 and secure the flange 112 to the backboard 122 once the bracket 108 and the narrow upper ends of the slots 114 have been properly set into its location vis-a-vis the bolts 116. One size hoop 106 may readily be changed to a hoop of a smaller (or larger) diameter, with its respectively longer (or shorter) upper portion 110 of the bracket 108, so that the center point "C" of each particular hoop 106 is equidistant from the backboard 122.

Turning now to FIGS. 10–27, another embodiment of the invention is shown which includes a new and improved breakaway mechanism which not only prevents damage from slam dunk shots (or from a player hanging on the hoop or rim), and which also permits quick hoop removal and replacement. It should be noted that for the sake of clarity and ease of understanding, not all elements are shown in every Figure where they might otherwise be seen.

Figure 10:
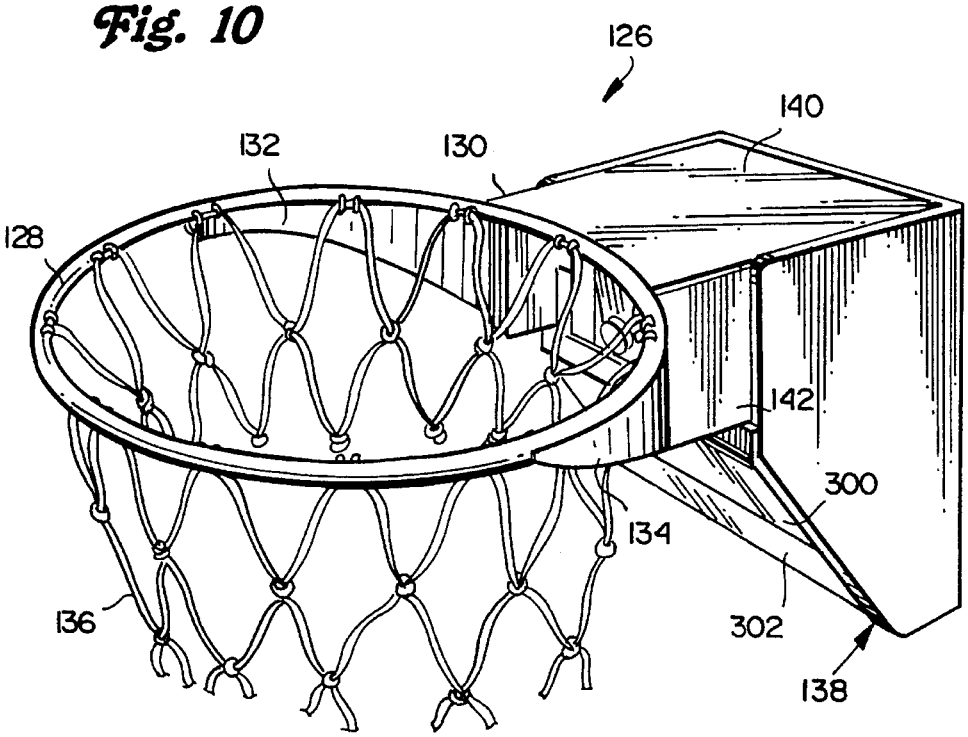
FIG. 10 is a perspective view of a hoop assembly and a hoop support and breakaway mechanism in accordance with this continuation-in-part application.

With initial reference to FIG. 10, the hoop assembly 126 includes a hoop or rim 128 with an integral hoop bracket 130 attached (e.g., by welding) to an arcuate segment of the hoop with the aid of reinforcement gussets or braces 132, 134. A conventional net 136 is secured to the hoop 128 in the usual manner. The bracket 130, in turn, is secured to a hoop support and breakaway mechanism 138 as described in detail below, and as illustrated generally in FIG. 12. The latter is adapted for attachment to a vertically disposed backboard, similar to that shown at 17 in FIG. 1. It will be appreciated that the hoop support and breakaway mechanism 138 in accordance with this continuation-in-part application, is adapted for use with interchangeable hoops having standard regulation diameters and diameters smaller than the regulation diameter in the same manner (including the same dimensional relationship between the hoops, associated brackets and backboard) as the earlier described breakaway or hinge mechanism.

Figure 11:
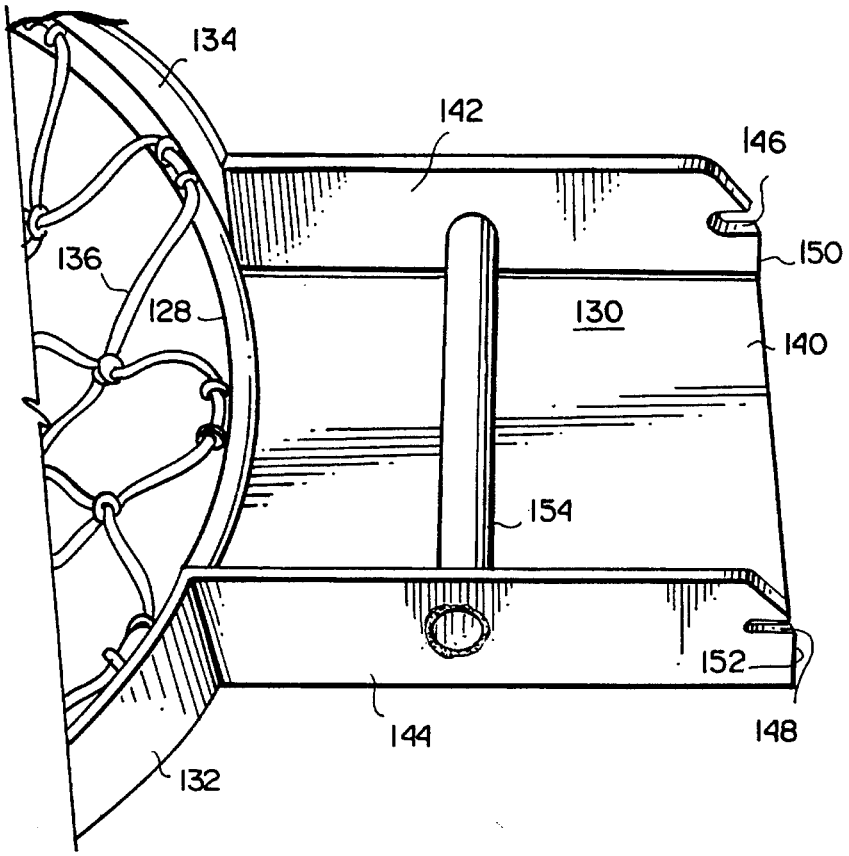
FIG. 11 is a partial perspective of the hoop assembly as shown in FIG. 10, but in an inverted position.
Figure 13:
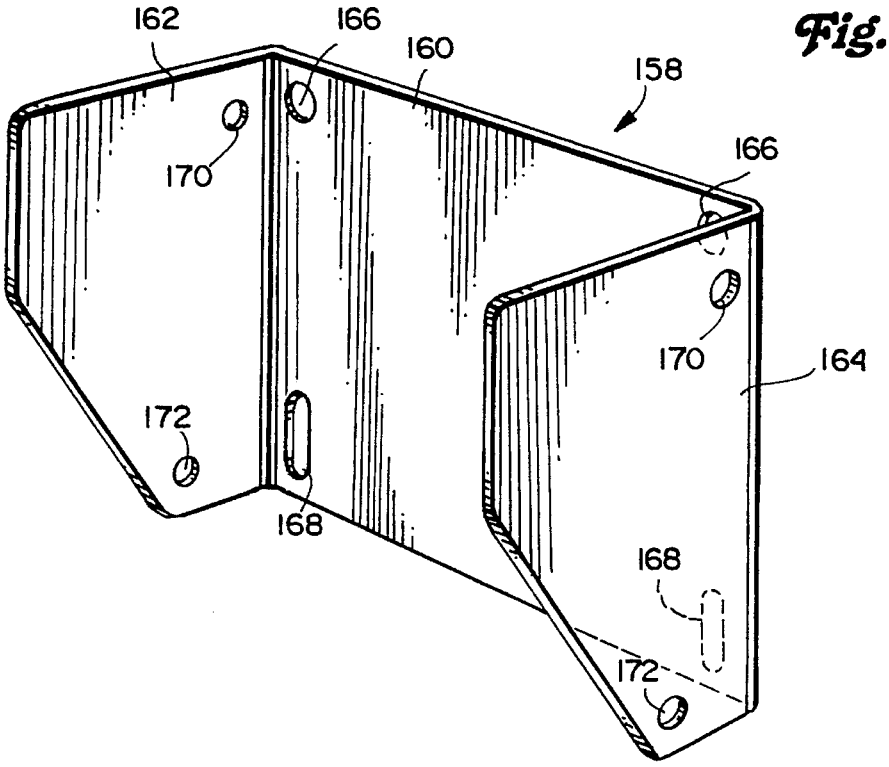
FIG. 13 is a perspective view of an outer frame support of the hoop support and breakaway mechanism.

The hoop bracket 130, as best seen in FIGS. 10 and 11, has a substantially inverted U-shape (when viewed in a normal operative position), and includes a planar upper platform or web 140 and a pair of downwardly extending side flanges 142, 144. Flanges 142, 144 are formed with horizontal slots 146, 148, respectively, in rearwardmost edges 150, 152. The slots 146, 148 open to the rear of the bracket and are designed to receive an upper horizontal axle or rod which serves as a pivot pin for the hoop support and breakaway mechanism as described in greater detail below. A hoop mounting rod 154 is welded into correspondingly sized apertures in the side flanges 142, 144 at a location approximately midway between the hoop 128 and the rearwardmost edge 156 of the hoop bracket 130.

In FIG. 10, the hoop assembly 126 is shown mounted in place on the hoop support and breakaway mechanism 138 which will now be described in detail. With specific reference to FIGS. 12 and 13, the hoop support and breakaway mechanism 138 includes a first or outer U-shaped frame support 158 which includes a vertical base 160 and a pair of laterally spaced and forwardly extending integral side plates 162, 164. The base 160 is provided with pairs of apertures 166, 168 for attaching the entire assembly to a backboard with suitable fasteners, such as bolts. Side plates 162, 164 are also formed with pairs of laterally aligned apertures 170, 172, the purpose for which will be described further herein.

Figure 14:
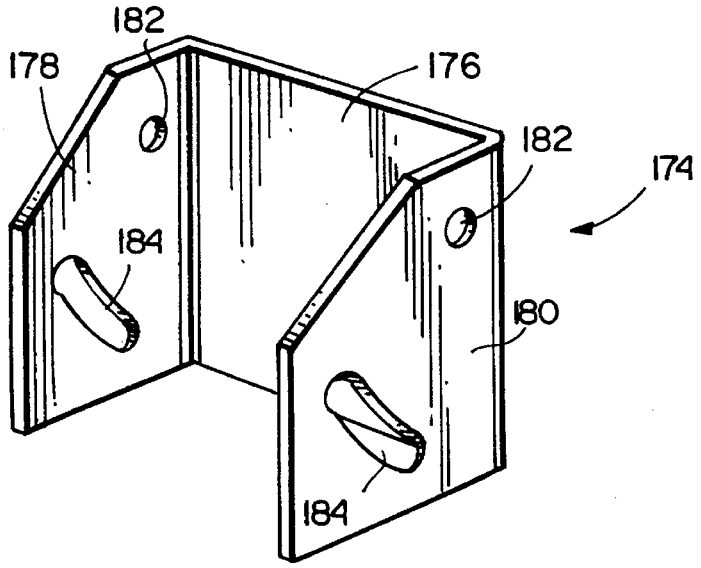
FIG. 14 is a perspective view of an inner frame support of the hoop support and breakaway mechanism.

The hoop support and breakaway mechanism 138 also includes a second, or inner frame support 174, best seen in FIG. 14. Frame support 174 is also a one-piece, U-shaped member including a vertical base 176 and a pair of laterally spaced and forwardly extending side plates 178, 180. Side plates 178, 180 are formed with a horizontally aligned pair of holes 182, as well as a horizontally aligned pair of substantially arcuate cam slots 184. The inner frame 174 is secured (by welding, for example) to the inside of the base 160 of the exterior frame support 158, centrally relative to side plates 162, 164, as best seen in FIGS. 15–18. Thus, it will been seen that the smaller, inner frame support 174 is secured within the outer frame support 158 such that holes 170 are aligned with holes 182. An upper horizontal axle or rod 185 extends through the holes 182 of the inner frame support 174 and are welded within holes 170 of the outer frame support 158. In addition, a lower horizontal axle or rod 186 is secured within the holes 172 at the lower end of the outer frame support 158.

Figure 19:
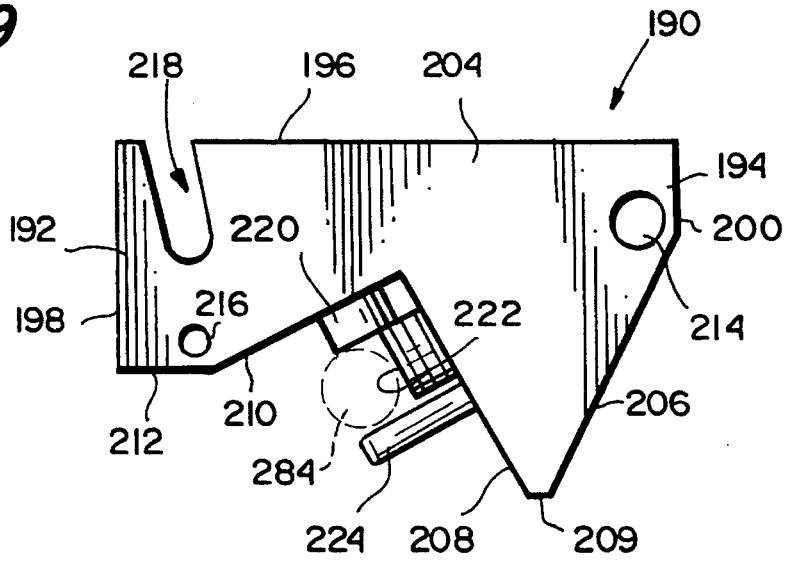
FIG. 19 is a side elevation of a hoop support block employed in the hoop support and breakaway mechanism.
Figure 17:
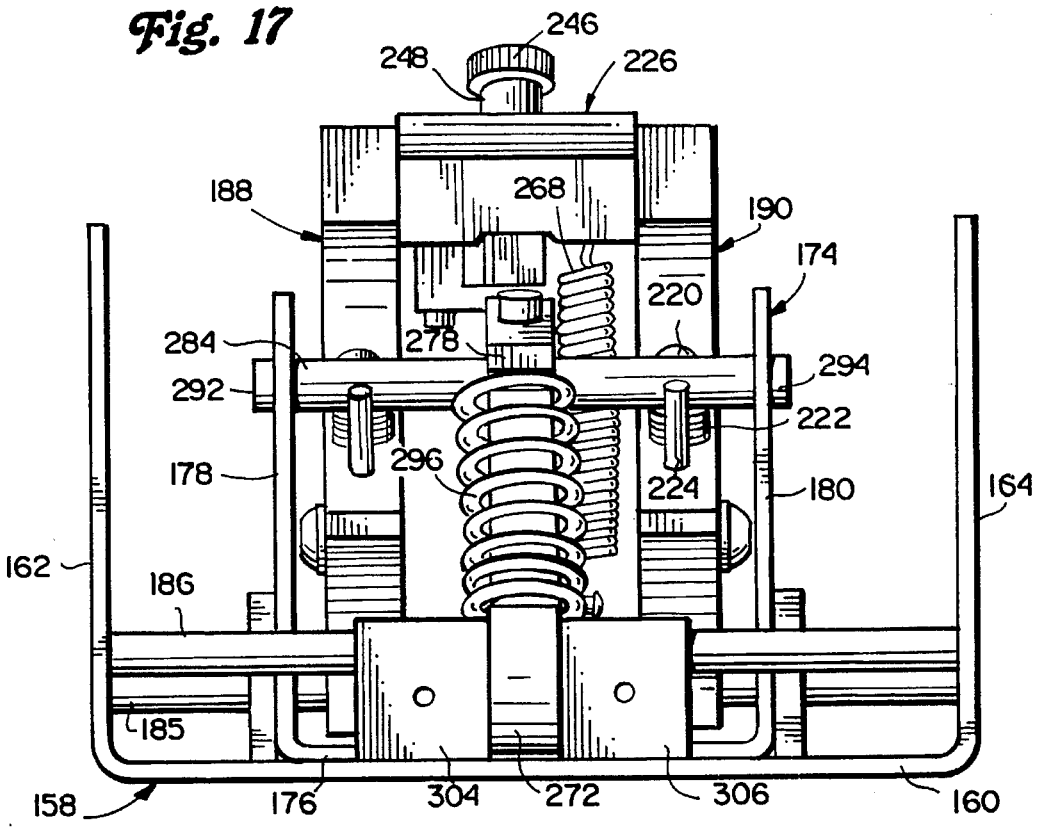
FIG. 17 is a bottom plan view of the hoop support and breakaway mechanism shown in FIG. 15.

Two identical hoop support blocks 188, 190, only one of which (i.e., block 190) need be described in detail, are pivotally mounted at their rearward ends on the upper axle 185 in laterally spaced relationship. Reference numerals used in the description of block 190 are intended to apply to block 188 as well. With particular reference to FIGS. 19 and 20, the block 190 is of irregular shape, and has a forward end 192 and a rearward end 194. The block, which may have a width dimension of about ¾", is formed of metal (e.g., aluminum or steel) and has as flat top surface 196, a forward vertical end surface 198, a rearward vertical surface 200, a pair of parallel side surfaces 202, 204, and a bottom surface consisting of oppositely angled surfaces 206, 208 (meeting at a truncated point 209). A third angled surface 210 extends forwardly and downwardly from surface 208, and a flat surface 212 connects to the vertical surface 198. The block is also provided with a pair of through holes 214, 216, and an elongated slot 218 extending downwardly and rearwardly from the forward end of top surface 196. As will be explained in greater detail below, the hoop mounting rod 154 is adapted to seat within the slot 218 in a fully mounted position. Thus, the width dimension of the slot is only slightly larger than the cross sectional diameter of the rod 154.

In a normal mounting position, the hoop support blocks 188, 190 are located within the inner frame support 174 and are pivotally secured on the pivot rod 185 such that the blocks extend forwardly, away from vertical base 160, parallel to the side plates 178, 180, with top surfaces 196 substantially horizontal.

As best seen in FIG. 19, a solid, hardened cylindrical disk 220 is preferably secured within a closed end bore 221 in surface 210 of the block 190, extending perpendicularly to the surface 210 and parallel to surface 208. A conventional disk washer stack or spring 222 extends perpendicularly from a closed end bore 223 in surface 208, and a solid, hardened pin 224 extends from another closed end bore 225 in surface 208, closely adjacent the disk washer spring 212. The function of disks 220, disk washer springs 222 and pins 224 will become apparent further below. In FIG. 2, which is an isolated bottom plan of the blocks 188, 190 in a normal operative position, the disks 220, washer stacks 222 and pins 224 are removed for the sake of clarity and to show how the latter are seated in the blocks.

A hoop lock block 226 is located laterally between and at the forward ends of the blocks 188, 190. More specifically, the lock block 226 (best seen in FIGS. 20–22) is pivotally secured between the blocks 188, 190 by a pin (not shown) extending through a bore 228 (FIG. 22) in the block 226, and secured at opposite ends within hole 216 (FIG. 19) in block 290 and a similar aligned hole in block 288.

The upper end of block 226 has a flat surface 230 and a bevelled surface 232 extending downwardly and rearwardly to a rearward facing, C-shaped recess 236. The block is also bevelled at 238 leading to the rear face 240 of the block. The front face of the block includes a surface 242 parallel to surface 240 and a perpendicular bottom surface 244 extends between the front and rear faces 242 and 240, respectively.

The front face 242 of the lock block 226 mounts a knob 246 and an associated spacer 248. A threaded shaft 252 secured to the knob extends through a vertical slot 250 (see FIG. 18) and is secured by a nut 254. A locking bar 256 is secured between the nut 254 and a shallow vertical groove 241 (see FIG. 20) formed in the rear face 240 of the block 226. As a result of this arrangement, the locking bar 256 is movable vertically by similar movement of the knob 246 within the slot 250, from a hoop locking position shown in solid lines in FIG. 21, to a non-locking or hoop release position shown in dotted lines in the same FIGURE A spring (e.g., a conventional coil spring, not shown) internal to the block, biases the bar 256 to the locking position shown in FIG. 21.

A side of the bar 256 facing the lock block 226 is cut out to provide a shoulder 258 and a bevelled edge 260 which, when in the position shown in FIG. 21, combine with recess 236 to lock the hoop mounting rod 154 within the lock block 226 (and also slots 218).

A guide keeper 262 is secured to the rear face 240 of the lock block and serves to prevent the lock bar 256 from separating from the rear face 240 of the lock block 226.

On the rear face 240 of the block 256, there is also formed a groove 264 and pin 266 arrangement for securing a coil spring 268 between the pin 266 and a spring support plate 270 (FIGS. 17 and 20) fixed to and extending forwardly of the pivot rod 185. The spring 268 biases the lock block to a closed or locking position, pulling the block in a clockwise direction as viewed in FIG. 21, about the pin 228.

Figure 24:
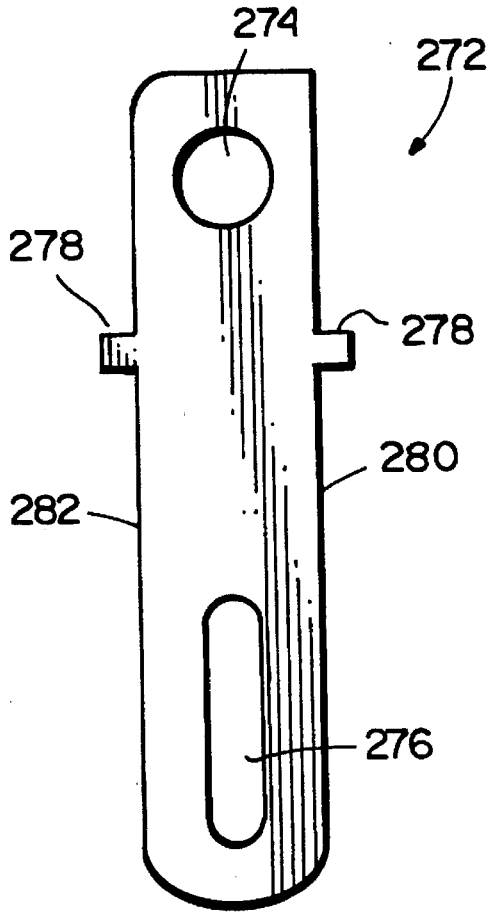
FIG. 24 is a side elevation of a spring control rod used in the hoop support and breakaway mechanism.

With reference to FIG. 24, a spring control rod 272, preferably of hardened steel construction and of substantially rectangular cross section, is formed with a bore 274 in its upper end, and an elongated slot 276 in its lower end, both of which extend transversely through the rod, i.e., perpendicular to its longitudinal axis. Shoulders 278 extend from the front and rear surfaces 280, 282, respectively. The manner in which the control rod is secured within the hoop support and breakaway mechanism 138 will be described further below.

With brief reference now to FIG. 23, there is shown a substantially cylindrical cam pin 284 formed with a centrally located annular groove 286, and with threaded blind holes 288, 290 at opposite ends of the pin for threadably securing a pair of conventional cam roller bearings 292, 294.

Returning to FIG. 18, it may be seen that the cam roller pin 284 is inserted within the bore 274 of the spring control rod 272, and centered therein by means of a set screw 296 which extends through the rod 272 and into the slot 286 of the cam pin to securely hold the latter within the rod 272. At the same time, the cam roller bearings 292,294 are received within the cam slots 184 of the inner frame support 174, for rolling movement therein as described below. It should also be noted here that when the cam pin is located within the cam slots 184, it is also located between the disks 220 and pins 224, and, in a normal position, compressively loads the disk springs 222 (as shown in phantom in FIG. 19). By this arrangement, any pivotal movement of blocks 188, 190 is transferred directly to the cam pin 284 and spring control rod 272.

The elongated slot 276 of the spring control rod 272 receives the lower horizontal axle 186. A coil spring 296 is telescoped over the spring control rod 272, between the rod 186 and the shoulders 278. Thus, spring 296 biases the control rod upwardly and resists any downward movement thereof.

The assembly and operation of the device will now be described. With the breakaway mechanism 138 secured to a backboard via suitable fasteners extending through holes 166 and slots 168 of the outer frame support 158, the hoop assembly 126 is located in an upwardly tilted orientation as shown in FIG. 27, such that slots 146, 148 of bracket 130 are engaged over the upper axle or pivot rod 185, closely adjacent the side plates 162, 164 of the outer support 158. The hoop assembly 126 may then be pivoted downwardly so that the hoop mounting rod 154 engages the bevelled edge 232 of the lock block 226. Further downward pivoting movement of the hoop assembly 126 will cause the block 226 to pivot outwardly (or forwardly) about pin 228 and against the action of spring 268, permitting the hoop mounting rod 154 to seat within the slots 218 of support blocks 188, 190. As the mounting rod 154 passes over bevelled edge 232 and into the slots 218, it also pushes the lock bar 256 downwardly (against the action of its internal coil spring), which, in turn permits the rod 154 to also seat within the recess 236. The lock block 226 then pivots inwardly to its closed position under the action of spring 268, while lock bar 256 moves upwardly to its locking position under the action of its own internal spring. The hoop assembly 126 is now locked in place in the hoop support and breakaway mechanism 138. Because of the close fitting relationship between the slots 146, 148, axle 185, hoop mounting rod 154, slots 218 and surfaces of the block 226 (defining the recess 236), the hoop assembly 126 is prevented from exhibiting unwanted movement in any direction.

Figure 25:
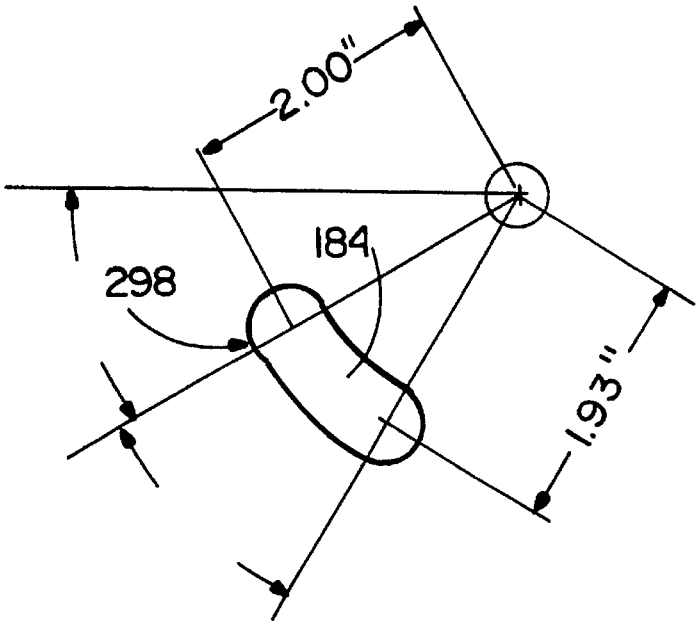
FIG. 25 is a schematic diagram illustrating dimensional relationships of arcuate cam slots used in the hoop support and breakaway mechanism.

Attention is now directed to FIGS. 14 and 25 wherein it can be seen that the arcuate slots 184 are formed with an enlarged detent at their uppermost ends, as indicated by reference numerals 298. In its normal operative position, the cam pin 284 is biased into the detents 298 by the spring action of the disk washer springs 222. This arrangement, in combination with the upward force exerted by coil spring 296, precludes any downward movement of the hoop assembly 126 and breakaway mechanism 138 during normal play.

At the same time, it will be appreciated that the combined spring rates of disk springs 222 and coil spring 296 determine the threshold or "breakaway" load which will cause the hoop support and breakaway mechanism 138 (and therefore also hoop assembly 126) to pivot downwardly about the upper axle 185. In the exemplary embodiment, this breakaway load is set at approximately 240 lbs., but it may be adjusted as desired.

When the hoop assembly is subjected to a downward load in excess of 240 lbs., as when subjected to a "slam dunk", the cam pin 284 will be forced out of the detents 298 (against the action of disk washer springs 222), and the hoop assembly 126 and hoop support and breakaway mechanism 138 will pivot downwardly about shaft upper axle 185. During this downward movement, the cam pin 284 will travel through the length of slots 184, while at the same time driving the spring control rod 272 downwardly against the action of coil spring 296. It will be appreciated that because the spring control rod 272 can pivot about the cam pin 284 as well as lower axle 186, and move axially as well as pivotally relative to the lower axle 186 by means of slot 276, the rod 272 does not impair the movement of the pin 284 within slots 184, but rather, accommodates such movement. Further in this regard, the length of slot 276 is sized relative to the lengths of arcuate cam slots 184 such that the downward pivoting movement of the hoop support and breakaway mechanism 138 bottoms out when the upper closed end of slot 276 engages the lower axle 186, and not by cam roller bearings 292, 294 bottoming out in slots 184. Significantly, and with specific reference to FIG. 25, the radius of the centerline of slot 184 is not concentric with the arcuate path of blocks 188, 190. In other words, and with reference to FIG. 25, the radius as measured from axle 185 to the slot centerline changes from 2.000" at the uppermost end of the slot to 1.937" at the lowermost end of the slot. This means that as the cam pin 284 travels through the slots 184, it is forced to roll rearwardly between the pins 224 and the disks 220, against the action of disk washer springs 222. It is this rearward movement of the pin 284, of about ⅛ inch, which necessitates that disks 220 and pins 224 be case hardened to provide good wear properties.

When the breakaway force has dissipated, the main spring 296 will reload or return the hoop assembly 122 (and hoop support and breakaway mechanism 138) to its normal operating position.

In order to change a hoop assembly 126, one merely pulls knob 246 outwardly and downwardly (in the slot 250), lifts the hoop 128 upwardly out of the lock block 226 and out of slots 218, and then forwardly to disengage slots 146, 148 from the upper axle 185. The new hoop, of the same size, or of perhaps smaller size for shooting accuracy drills, is attached in the manner described above.

It will thus be appreciated that the hoop breakaway mechanism 138 of this invention provides easy interchangeability in a breakaway configuration that otherwise displays the properties and characteristics of a solid, permanently attached hoop, i.e., without bounce or vibration.

Finally, reference is again made to FIGS. 12, 18, 26 and 27 wherein a pair of cover plates 300 and 302 are shown which protect and enclose the hoop support and breakaway mechanism within the outer frame 158.

The lower cover plate 302 which is generally L-shaped, is secured to the lower front of the outer frame 158 by means of fasteners (e.g., screws) which are received within a pair of angles 304 and 306 (see FIGS. 15, 17 and 18) which, in turn, are welded to the lower end of base 160. It should be noted that angles 304,306 also maintain the spring control rod 272 centered on the lower axle 186.

Figure 12:
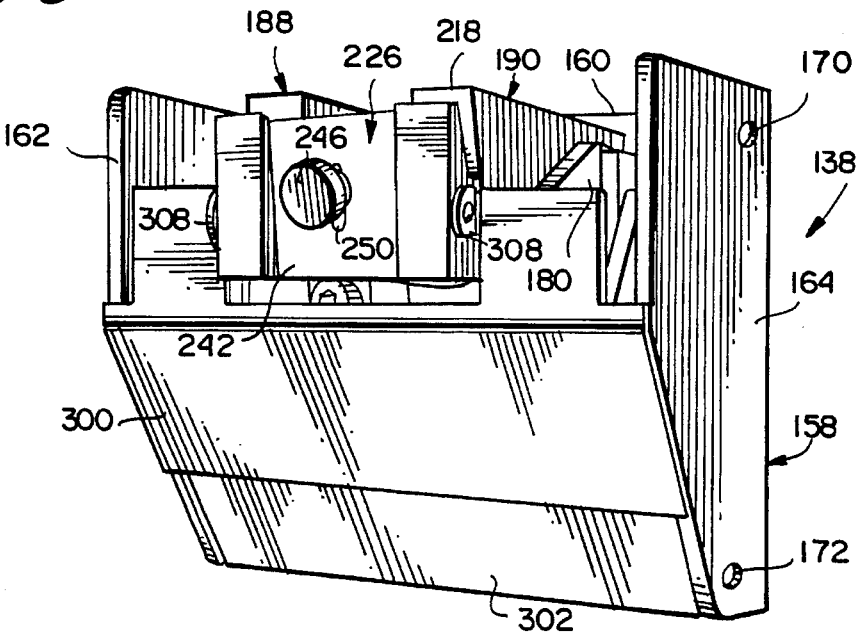
FIG. 12 is a partial perspective of the hoop support and breakaway mechanism shown in FIG. 10, but with the hoop assembly removed.

The upper cover plate 300 is secured by fasteners (e.g., screws) which extend through cover plate tabs 308 and into the hoop support blocks 188, 190 as best seen in FIGS. 12, 26 and 27. Because the upper cover plate is secured to the pivotally mounted hoop support blocks, this plate will move with the hoop support blocks during the application of a breakaway force to the hoop assembly. The assembly is such, however, that the upper cover plate 300 will slide over the lower cover plate during such movement, so as not to interface with the operation of the hoop support and breakaway mechanism 138.

Figure 18:
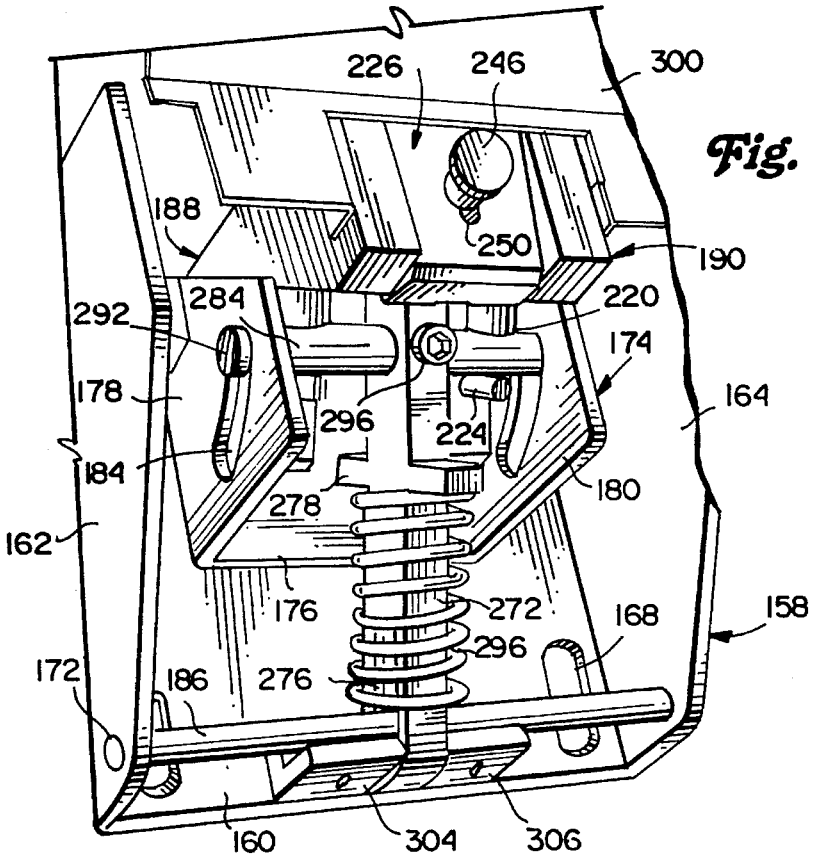
FIG. 18 is a partial perspective of the hoop support and breakaway mechanism shown in FIGS. 15–17.

The upper cover plate 300 is also pivotable upwardly relative to the support blocks 188, 190 so as to gain access to the interior elements, as best seen in FIG. 18. A spring 310 (shown only in FIG. 26), extending between the plate 300 and a spring support plate 312 (mounted on shaft 185) maintains the plate 300 in a normally closed position. A similar spring may be employed on the opposite side of the plate if desired.

Thus, what has been shown is a plurality of different diameter hoops beginning with a "regulation" diameter hoop with one particular length bracket and extending to smaller hoops have longer horizontal portion brackets so that the different diameter hoops all have a common center point equidistant from its backboard, once they have been properly secured thereto. It is critical to this invention that the basketball player see only one hoop when shooting the basketball, and that each different size hoop be equidistantly spaced from the backboard when they have been changed one hoop for the other. The various size hoops can be all attached to a common hoop support and breakaway mechanism as described herein, the differing length brackets having a common attachment arrangement adaptable to the common support means on the backboard. The plurality of hoops and brackets may be configured as part of a kit or it may be arranged to be retrofitted to an existing backboard.

It is intended that the appended claims be interpreted in an exemplary and not a limiting sense.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A basketball hoop and hoop support assembly comprising:

a first outer frame support adapted for attachment to a backboard and having a first upper transverse axle secured therein;

a hoop assembly including a hoop and a mounting bracket, said mounting bracket having a pair of sides, each with a slot adapted to engage said first axle, said mounting bracket also having a mounting rod extending between said sides and parallel to said first axle; and a hoop support and breakaway mechanism located within said first outer frame support and pivotally secured to said first axle for permitting said hoop assembly to pivot downwardly under a predetermined load, said breakaway mechanism including spring loaded quick release means for releasably capturing said mounting rod.

2. The hoop and hoop support assembly of claim 1 wherein said hoop support and breakaway mechanism includes a pair of laterally spaced support blocks mounted at rearward ends thereof for pivotal movement about said first axle, and said quick release means includes a lock block secured between said laterally spaced support blocks at forward ends thereof, said support blocks and said lock block formed with slots adapted to receive said mounting rod.

3. The hoop and hoop support assembly of claim 2 wherein said lock block is pivotally secured between said laterally spaced support blocks between an open position permitting removal or attachment of a hoop assembly, and a closed position retaining said hoop assembly in said breakaway mechanism.

4. The hoop and hoop support assembly of claim 3 wherein said lock block is provided with a spring loaded locking bar for locking said mounting rod in said breakaway mechanism.

5. The hoop and hoop support assembly of claim 2 wherein said hoop support and breakaway mechanism includes a spring biased control rod connected at an upper end to said pair of laterally spaced support blocks and at a lower end to a lower, second axle secured to said first outer frame.

6. The hoop and hoop support assembly of claim 5 wherein said spring biased control rod is formed with an elongated slot at said lower end, said lower second axle passing through said elongated slot.

7. The hoop and hoop support assembly of claim 6 wherein said spring biased control rod is formed with a transverse bore at said upper end, and wherein a transverse cam pin passes through said transverse bore, said cam pin having cam bearings at opposite ends thereof received in respective cam slots provided in parallel side plates of a second, inner frame support secured within said first outer frame support.

8. The hoop and hoop support assembly of claim 7 wherein said cam pin is sandwiched between wear surfaces provided on said pair of laterally spaced support blocks.

9. The hoop and hoop support assembly of claim 8 wherein said hoop support blocks are provided with spring members for biasing said cam pin into detents formed in said cam slots.

10. The hoop and hoop support assembly of claim 9 wherein said spring members and said spring biased control rod determine a breakaway force for commencing downward pivoting movement of said hoop assembly and said breakaway mechanism.

11. The hoop and hoop support assembly of claim 10 wherein said breakaway force is approximately 240 lbs.

12. A basketball hoop and hoop support assembly comprising:

a first outer frame support adapted for attachment to a backboard and having a first upper transverse axle secured therein;

a second inner frame support secured within said first outer frame;

a hoop assembly including a hoop and a mounting bracket, said bracket having a pair of sides, each with a slot adapted to engage said first axle, said mounting bracket also having a mounting rod extending between said sides and parallel to said first axle; and a hoop support and breakaway mechanism located within said first frame support and pivotally secured to said first axle permitting said hoop assembly to pivot downwardly under a predetermined load; wherein downward pivoting movement of said breakaway mechanism is opposed by substantially horizontal and substantially vertical spring forces.

13. The basketball hoop and hoop support assembly of claim 12 including a spring biased control rod operatively connected at an upper end to a pair of laterally spaced support blocks and at a lower end to a lower, second axle secured to said first outer frame support, and an associated coil spring mounted over said rod between said second axle and at least one shoulder on an upper portion of said control rod.

14. The hoop and hoop support assembly of claim 13 wherein said spring biased control rod is formed with an elongated slot at said lower end, said lower, second axle passing through said elongated slot.

15. The hoop and hoop support assembly of claim 14 wherein said spring biased control rod is formed with a transverse bore at said upper end, and wherein a transverse cam pin passes through said transverse bore, said cam pin having cam bearings at opposite ends thereof, received in respective cam slots provided in parallel side plates of said second, inner frame support.

16. The hoop and hoop support assembly of claim 15 wherein said cam pin is sandwiched between wear surfaces provided on said pair of laterally spaced support blocks.

17. The hoop and hoop support assembly of claim 16 wherein said pair of laterally spaced support blocks are provided with spring members for biasing said cam pin into detents formed in said cam slots.

18. The hoop and hoop support assembly of claim 17 wherein said spring members and said coil spring determine a breakaway force for commencing downward pivoting movement of said hoop assembly and said breakaway mechanism.

19. The hoop assembly of claim 12 and further including a spring loaded quick release means for releasably capturing said mounting rod within said breakaway mechanism.

* * * * *